US005435250A

United States Patent [19]

Pollock

[11] Patent Number: 5,435,250

[45] Date of Patent: Jul. 25, 1995

[54] EXPLOSIVE PACKAGING SYSTEM

[76] Inventor: Edward S. Pollock, 7265 Chattahoochee Bluff Dr., Doraville, Ga. 30340

[21] Appl. No.: 950,691

[22] Filed: Sep. 25, 1992

[51] Int. Cl.[6] ..... F42B 3/00

[52] U.S. Cl. ..... 102/317; 102/323; 102/331

[58] Field of Search ..... 102/317, 323, 331

[56] References Cited

U.S. PATENT DOCUMENTS

| | | | |
|---|---|---|---|
| 2,425,472 | 8/1947 | Hodgson et al. | 102/24 |
| 3,082,689 | 3/1963 | Griffith et al. | 102/24 |
| 3,407,730 | 10/1968 | Griffith | 102/24 |
| 4,023,494 | 5/1977 | Barton et al. | 102/24 |
| 4,037,536 | 7/1977 | Griffith | 102/20 |
| 4,178,852 | 12/1979 | Smith et al. | 102/24 R |
| 4,383,484 | 5/1983 | Morrey | 102/275.3 |
| 4,433,625 | 2/1984 | Brown | 102/331 |
| 4,485,741 | 12/1984 | Moore et al. | 102/331 |
| 4,593,622 | 6/1986 | Fibranz | 102/530 |
| 4,815,384 | 3/1989 | Ringel et al. | 102/307 |
| 5,212,342 | 5/1993 | Eches et al. | 102/317 |
| 5,282,423 | 2/1994 | Sikorski et al. | 102/431 |

*Primary Examiner*—Peter A. Nelson
*Attorney, Agent, or Firm*—Hopkins & Thomas

[57] ABSTRACT

A packaging system for explosives having a thin walled water resistent tube containing a low-sensitivity explosive therein. A first cap is fitted about one end of the tube and has a re-entrant portion that projects into the tube about which the explosive material is filled. The other end of the tube is sealed with a second cap to create a substantially water-tight explosive package. An initiator is received within an open-ended cavity formed in the re-entrant portion of the first cap and is detonated for setting off the explosive charge.

11 Claims, 3 Drawing Sheets

EXPLOSIVE PACKAGING SYSTEM

FIELD OF THE INVENTION

The present invention relates in general to a packaging system. More particularly, the invention relates to a packaging system for low sensitivity or other types of explosives that is easily and economically constructed and which seals the explosives in a substantially watertight package for detonation.

BACKGROUND OF THE INVENTION

In conventional blasting operations, at construction sites, quarries, and the like, the location and placement of the charges of explosives is first determined and then blast holes are drilled. An explosive charge is then positioned within each of the blast holes with the size of the charge being dependent on the size of the blast required and the terrain or configuration of the site itself, and, thereafter, the charge is detonated. There are, in general, two principal types of explosives commonly used for blasting operations. The first type is hard powder explosives such as dynamite. The second type used is low sensitivity explosives such as an ammonium nitrate/diesel fuel mixture known as ANFO.

Dynamite is probably the most common explosive used in conventional blasting operations. This is because dynamite, and other similar hard powder explosives, can be easily measured and sized to ensure a high degree of control of the blasting. Additionally, dynamite, because it is substantially unaffected by moisture, can be used for blasting holes where there is a high moisture content as is typically present at most conventional blasting sites. The main drawback to such hard powder explosives is their expense. Hard powder explosives such as dynamite are very expensive to use, thus significantly increasing the costs of blasting. Additionally, dynamite is a Class A explosive, requiring strict compliance with a number of federal regulations governing its transport, storage, and use. Another drawback to the use of dynamite is that it is often difficult to position the dynamite sticks in a blasting hole. Often, roots and rock outcroppings project into the blasting hole and can catch or block the path of the dynamite sticks. The dynamite sticks also have a tendency to twist and catch the sides of the blasting hole, often causing blockage thereof. This prevents the charge from being seated properly for blasting and can even cause the sticks to be broken so that they cannot be completely exploded.

Low sensitivity explosives, such as ANFO, are easier to handle and are more stable than the hard explosives. Perhaps the biggest advantage of ANFO is, however, the cost. ANFO and other low sensitivity explosives are much less expensive to use than dynamite, and are Class C explosives that are not subject to the extensive federal regulations applicable to the Class A hard powder explosives. Additionally, ANFO can be packaged for loading and used with relative safety and ease by workers at the blast site itself. This provides a significant advantage as it is generally not possible to know how much explosive is required to blast a particular site until the site is drilled and inspected. Thus, when ANFO is used, workers regulate, package, and use the amounts of explosives they need on site after-determining the amount required.

The problem with ANFO and other such low sensitivity explosives is that they are much more limited in application than the hard explosives. Most blasting sites have a high amount of moisture present due to rain or water in the ground, which, when mixed with ANFO, dilutes the mixture and prevents its detonation. Thus, it has generally not been possible to use the cheaper conventional ANFO at most conventional blasting sites due to the presence of moisture. Explosive slurries containing an ANFO mixture are available for use in some "wet" blast holes. Such slurries are pumped into a blast hole, forcing the water out. However, such mixtures are fairly expensive, similar to hard powder explosives. Thus, the use of such slurries significantly increases the costs of blasting, much more so than using ANFO alone.

There have been numerous arrangements for packaging explosives in sealed containers for shipment and subsequent detonation. Examples of such containers are disclosed in U.S. Pat. Nos. 2,425,472, 4,023,474, 4,037,536, 4,383,484, and 4,485,741. The primary function of such containers is, however, safer storage and transport of hard powder explosives such as dynamite or trinitrotoluene (TNT), and not the protection of the explosive from moisture.

One of the biggest problems with such explosive packages is that they contain only a limited amount of explosive material sealed in the package by the explosive manufacturer. Since, as pointed out hereinbefore, it is generally not possible to know the amount of explosives that will be required to blast a particular site, it is not possible to know how much or how many explosive packages will be required before the job starts. If the amount of explosives is underestimated, blasting must be held up until more packages or canisters are shipped. Additionally, these explosive packages are expensive, and thus the costs of blasting are increased when additional canisters must be obtained. Even explosive cartridges such as disclosed in U.S. Pat. No. 3,082,689, which discloses an explosive package containing a fixed amount of an ammonium nitrate explosive (ANFO), are much more expensive to use than unpackaged ANFO, especially where a precise determination of the amount needed involves a fractional part of a package. ANFO is relatively simple and easy to mix, and, thus, the workers in the field can mix and use ANFO in precise amounts much more cheaply than buying such prepackaged cartridges.

Accordingly, it can be seen that it is desirable to provide a packaging system for explosives that enables relatively inexpensive, low sensitivity explosives to be easily and economically packaged in precise amounts at the blasting site in containers sealed against moisture for safe, reliable, and economic blasting operations.

SUMMARY OF THE INVENTION

Briefly described, the present invention comprises a packaging system for explosives designed primarily for blasting applications. The packaging system includes an open-ended tube such as a section of pipe formed from polyvinyl chloride or similar water-resistant plastic material. The tube is formed in sections of between two to twenty feet in length and can be of varied diameters according to standardized pipe sizes. The tube includes a thin substantially cylindrical side wall defining an open-ended cylindrical holding chamber that extends along the length of the tube, the precise capacity of which is set by cutting the tube to a predetermined length. A first cap is positioned over and mates with the first open end of the tube, and a second cap is positioned over and mates with the second open end of the tube to form an explosive containing cartridge or canister.

The first cap is formed from an extruded plastic material and includes a substantially cylindrically shaped re-entrant portion. The re-entrant portion has an outer diameter that is substantially less than the inner diameter of the tube, and includes an end closure wall, an open end opposite the end closure wall, and a cylindrical side wall defining an open-ended cavity within the re-entrant portion. A bend is formed in the side wall adjacent the open end of the re-entrant portion. The cylindrical side wall curves about the bend and extends substantially parallel to and spaced from the re-entrant portion to form thereby an outer sleeve surrounding and spaced from the re-entrant portion. The outer sleeve thus formed has a longitudinal portion that extends parallel to the re-entrant portion and a tapered portion extending between the bend in the side wall and the longitudinal portion of the outer sleeve. The outer sleeve has an inner diameter that is slightly greater than the outer diameter of the tube so that it fits over and frictionally engages the outer side wall of the tube.

The first cap is urged over the first open end of the tube, with the re-entrant portion extended into the holding chamber within the tube. The cap is urged onto the tube until the open end of the tube engages the tapered lower portion of the outer sleeve and further movement of the first cap over the tube is resisted. An adhesive, applied in a circular bead about the end of the tube secures the first end of the tube to the interior side wall of the outer sleeve, or other means may be used to secure the cap to the sleeve. As a result, the first cap is secured to the first end of the tube to enclose and seal the first open end of the tube against the leakage of moisture therethrough with the re-entrant portion extending into the tube. An initiator for initiating an explosive blast is received within the open-ended cavity of the re-entrant portion. The initiator includes a booster formed from an explosive material such as a half-stick of dynamite which is seated within and engages the interior side wall of the re-entrant portion, and a detonator, such as a blasting cap or similar detonating means, which is inserted into the booster for setting it off.

Once the first cap has been secured to the first end of the tube, the tube may be filled through the second open end with a low sensitivity explosive mixture such as an ammonium nitrate/diesel fuel mixture (ANFO). The explosive material is contained within the holding chamber of the tube and surrounds the re-entrant portion of the first cap.

The second cap is formed from an extruded plastic material and includes an outer cylindrical wall having an inner diameter slightly greater than the outer diameter of the tube so as to engage the side wall of the tube in a frictional or slip fit and further having a recessed transverse wall portion. The recessed wall has a cylindrical member formed on and projecting outwardly therefrom. The cylindrical projection is spaced from the walls of the recessed portion of the second cap, and forms a recess therewith. The bend formed in the side wall of the first cap of an adjacent canister is received and seated within the recess, with the circular projection of the second cap adapted to extend into the open-ended cavity of the re-entrant portion of the first cap of the adjacent canister. Such a construction enables additional explosive packages to be stacked one on top of another in a seated relationship to form extended lengths of explosive packages as needed. The second cap is urged onto the second open end of the tube and affixed thereto, as by an adhesive, to seal the tube with the explosive material contained therein, forming a water-tight explosive package.

In an alternative embodiment of the packaging system for explosives, the first and second caps are extruded in alternative shapes for different blasting operations, such as at quarries or the like. The first cap is formed as a substantially U-shaped member having a closed end, an open end opposite the closed end and a conically shaped side wall adapted to engage one open end of the tube. The side wall defines an open ended chamber or recess within the first cap. The booster material of an initiator is received within the chamber in the first cap. Passages are typically formed through the first cap and through the initiator, in which a detonating means for the initiator is received for detonating the booster to initiate an explosion. As an alternative, the detonating means can be embedded within the booster material and connected to insulated terminals that project through the side wall of the first cap. Wires can be connected to the terminals to connect the terminals, and thus the detonating means to an electric circuit for detonating the blast.

The second cap is an M-shaped member having a side cylindrical wall with upper and lower edges. A hemispheric depression or recess is formed within the upper edge of the side wall. The closed end of the first cap is received and seated within the depression so that successive explosive packages may be stacked end to end in series.

DETAILED DESCRIPTION OF THE PREFERRED EMBODIMENT

Figures 1, 2:
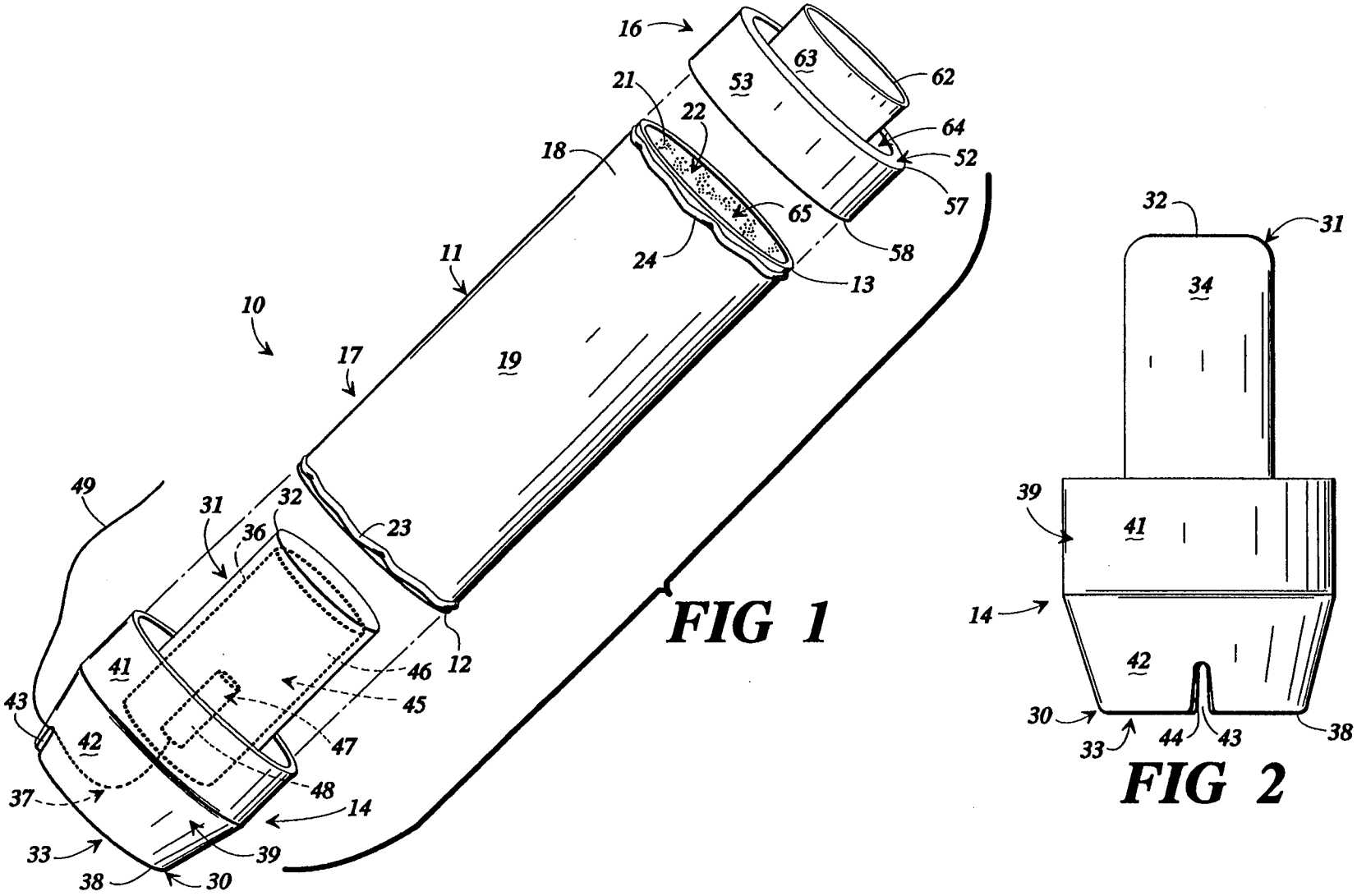
FIG. 1 is an exploded perspective view of the packaging system for explosives.
FIG. 2 is a side elevational view of the first cap of the packaging system.

Referring now in greater detail to the drawings in which like numerals refer to like parts throughout the several views, FIG. 1 illustrates in exploded perspective a packaging system 10 for explosives. The packaging system includes a hollow tube or cylinder 11 having a first open end 12 and a second open end 13. It is to be understood that the length of tube 11 and hence its capacity is determined by the amount of explosive to be contained within tube 11. A first cap 14 is adapted to be positioned over the first open end 12 of the tube 11 and a second cap 16 is adapted to be positioned over the second open end 13 of the tube to form a substantially water-tight explosive package 17.

The tube 11 is typically a section of pipe preferably formed from polyvinyl chloride (PVC) or a similar lightweight water-resistent plastic material. The tube 11 includes a cylindrical side wall 18 having an outer surface 19 and a cylindrical inner surface 21 that defines a holding chamber 22 therein. The side wall 18 has a thickness within a range of approximately 0.035 inches to approximately 3/16 of an inch and has an outer diameter of between 1 inch up to approximately 15 inches. Generally, the side wall 18 of the tube is formed to be as thin as possible to conserve materials while maintaining strength. It will, however, be understood that tubes of greater or lesser diameters and thicknesses, such as standardized size pipes, can also be utilized. Typically, the tube is formed in sections of between two to six feet in length for packaging various quantities of explosives as desired.

As FIG. 1 illustrates, circular beads of adhesive 23 and 24 are applied respectively about the first open end 12 and second open end 13 of the tube 11. The adhesive beads 23 and 24 are formed from an adhesive such as PVC cement or a similar contact cement that provides a substantially water-tight adhesive seal between the first cap 14 and second cap 16 and the first 12 and second 13 ends of the tube. The adhesive beads function as a means for securing the caps to the ends of the tube. While adhesive cement has been illustrated, other methods of affixing the end caps 14 and 16 to the ends 12 and 13 to produce a watertight seal might readily be used.

Figure 3:
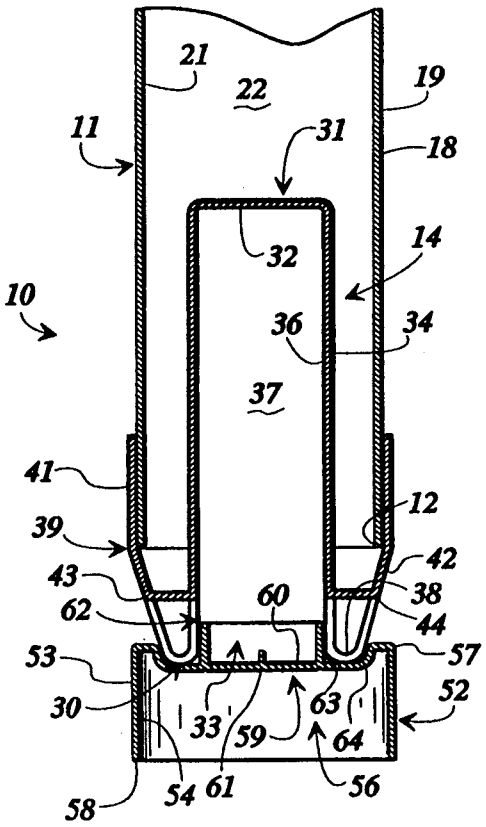
FIG. 3 is a cross-sectional view of the packaging system showing the inter-fitting of the tube and first cap and the seating of the first cap with a second cap.

The first cap 14 is received over the first open end 12 of the tube 11 as illustrated in FIG. 1. As shown in FIGS. 1, 2, and 3, the first cap 14 has a substantially unitary construction, with a substantially W-shaped cross-section (FIG. 3). The cap 14 is preferably formed from an extruded plastic material such as PVC or a similar lightweight plastic, and includes a cylindrically shaped re-entrant portion 31. As shown in FIGS. 2 and 3, the re-entrant portion 31 includes an enclosed end closure wall 32 at one end and an open end 33 formed at the base 30 of the first cap remote from the end closure wall 32, and a substantially cylindrical side wall 34. The side wall extends longitudinally from the end closure wall 32 to the open lower end 33 and includes a cylindrically shaped inner side surface 36 defining an open ended cavity 37 within the first cap 14. A bend 38 is formed in the side wall 34 at the base 30 of the first cap. The side wall curves about the bend 38 and extends upwardly along the length of the re-entrant portion. The side wall extends over a portion of its length substantially parallel to and is spaced apart from the re-entrant portion 31, forming an outer sleeve 39 coaxial with and surrounding the re-entrant portion 3.

As FIGS. 2 and 3 illustrates, the outer sleeve 39 includes a longitudinal upper portion 41, which is spaced from the re-entrant portion 31 and extends parallel thereto. An inwardly tapered lower side wall portion 42 extends downwardly from the upper portion 41 inwardly at an angle toward the bend 38 formed in side wall 34 at the open end 33 of the re-entrant portion 31 at the base 30 of the first cap 14. It is to be understood that the terms "upward", "upper", "lower", etc. are used simply for purposes of orientation of the parts, and do not define the positions of these parts when the package is being used. As shown in Pig. 2, slots 43 and 44 are formed in the side wall 34 adjacent the bend 38 at the base 30 of the first cap on opposite sides of the first cap. The slots 43 and 44 have a substantially inverted U-shaped configuration and are formed through the side wall, extending longitudinally approximately $\frac{3}{8}$ of an inch. The slots 43 and 44 are of different sizes, with slot 43 being approximately 0.05 inches in width and slot 44 being approximately 0.15 inches in width. The two slots of differing sizes are provided to accommodate detonating cords of different types of detonators to provide a guide for the cords and prevent the cords from shifting or rubbing against the base of the first cap. For example, if an electrical detonator is used, having a relatively thin electrical wire, the thin electrical wire is extended through slot 43. If a hydraulic detonator, having a thicker, tubular cord that is too large for slot 43, is used, the cord is extended through slot As FIG. 3 illustrates, the outer sleeve 39 of the cap 14 has an inner diameter that is slightly greater than the outer diameter of the tube 11. For example, if a so-called two-inch standard pipe is used for the tube 11, it will have an outer diameter of approximately $2\frac{3}{8}$ of an inch. The outer sleeve 39 will accordingly preferably have an inner diameter of approximately 2.385 inches to enable the outer sleeve to fit about and frictionally engage the outer surface of the side wall of the tube at the first end of the tube 11.

As shown in FIG. 1, an initiator 45, shown in dashed outline, is received within the open-ended cavity 37 of the re-entrant portion 31 of the first cap 14. The initiator typically comprises a booster 46 and a detonator 47. The booster 46 is an explosive charge, typically a half-stick of dynamite, which fits within the open-ended cavity 37. The booster 46 is received within the open-ended cavity preferably in frictional contact with the inner side surface 36 of the side wall 34 to secure the booster within the re-entrant portion. The detonator 47 is generally a conventional blasting cap comprising a cap 48 with a wire or detonating cord 49 projecting from its lower end and out of the open-ended cavity 37. As illustrated in FIG. 1, the blasting cap 48 is embedded within the booster 46 and the wire 49 is passed through one of the slots 43 or 44 (FIG. 2) formed in side wall 34 at the base 30 of the first cap 14. The opposite end of the wire is connected to a detonating means such as a plunger or electric circuit (not shown) for setting off the detonator to explode the initiator.

Figure 4:
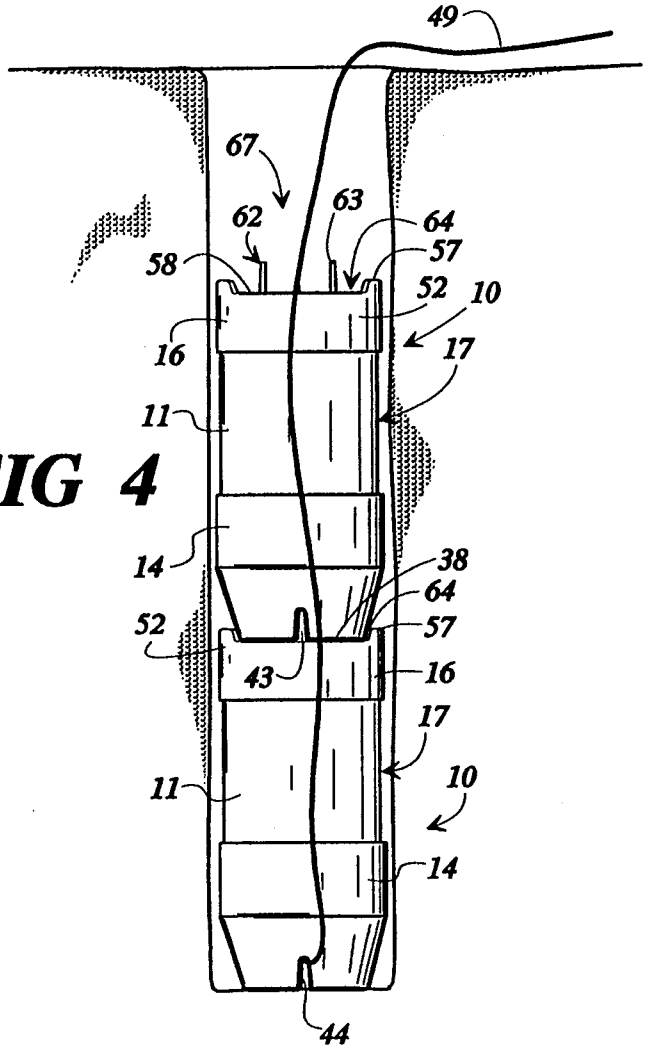
FIG. 4 is a side elevational view of the explosive packaging system in use in a blasting hole with one explosive package stacked on another.

As FIG. 1 illustrates, the second cap 16 is positioned over and fits about the second open end 13 of the tube 11. The second cap is preferably formed from an extruded plastic such as polyvinyl chloride or similar light-weight water resistent plastic and has a substantially unitary construction. The second cap 16 (FIG. 3) has a substantially cylindrically shaped outer side wall 52 that projects downwardly. The side wall 52 has an external surface 53, an internal surface 54 defining an open-ended recess 56 in the second cap and circular upper and lower edges 57 and 58. A recessed transverse end wall 59 is positioned within and recessed slightly below the circular upper edge 57 of the side wall 52 and includes a first surface 60 and a second surface 61. As illustrated in FIG. 3, a substantially cylindrical member 62 is formed on the surface 61 of the recessed end wall 59 and projects outwardly therefrom. The cylindrical member 62 includes a substantially circular side wall 63 spaced from the upper edge 57 of the side wall 52. A trough or recess 64 is formed between the side wall 63 of the cylindrical member 62 and the side edge of the side wall 52. The recess is of a width approximately equivalent to the width of the bend 36 formed in side wall 34 of the re-entrant portion 31 of the first cap 14 at the base of the first cap, for enabling the first cap of an adjacent canister or cartridge to be seated within the recess to permit stacking of several explosive packages 17 in series as illustrated in FIGS. 3 and 4.

As shown in FIG. 1, an explosive material 65 is contained within the holding chamber 22 of the tube 11. The explosive material is typically a low sensitivity Class C explosive, although other types of explosives such as dynamite or similar Class A explosives can be utilized as well. Preferably, a mixture of ammonium nitrate and diesel fuel, commonly known as ANFO, is used because of its low cost and stability and its susceptibility to being easily measured and packaged on site. The ANFO mixture is generally a granular material, purchased in mass containers such as fifty pound bags. A premeasured quantity of ANFO is poured into the holding chamber 22 of each tube. Controlling the amount of ANFO used enables control of the blasting of the site based upon the blast characteristics of known amounts of ANFO explosive. Therefore, the size of the explosive package can be tailored to match the blast required.

In operation and use of the packaging system 10 for explosives (FIG. 1), a section of tube 11 of a desired length in diameter, e.g. a two-foot long tube with a two-inch diameter, is coated with beads of adhesive 23 and 24 about its open first and second ends 12 and 13. A first cap 14 is positioned over and is urged onto a first open end 12 of the tube. As FIG. 3 illustrates, the re-entrant portion 31 of the first cap projects into the holding chamber 22 of the tube 11. The longitudinal portion 41 of side wall 34 of the outer sleeve 39 engages the outer surface 19 of the side wall 18 of the tube in frictional contact to form a friction fit therebetween. The first cap is urged onto the tube until the first end of the tube engages the tapered lower portion 42 of the outer sleeve 39 and further movement of the first cap onto the tube is prevented. The tight frictional fit of the side wall of the outer sleeve of the first cap with the outer surface of the side wall of the tube and the adhesive contact of the outer sleeve 39 with bead of adhesive 23 coated about the tube, securely fix the first cap to the first end of the tube. Thus, the first end of the tube is engaged and sealed with a substantially water-tight seal.

With the bottom end 13 of the tube 11 thus sealed, a measured amount of an explosive material 65, such as a slurry of ANFO, is poured into the holding chamber inside the tube until the tube is substantially filled. Thereafter, the second cap 16 is placed over and is urged onto the second end 13 of the tube. The second cap is urged onto the tube until the second end 13 of the tube engages the lower surface 60 of the recessed transverse end wall 59 of the second cap. The inner side surface 54 of the side wall of the second cap frictionally engages the outer surface 19 of the side wall 16 of the tube and engages the bead of adhesive 24 about the second end of the tube. The frictional engagement of the inner side surface of the side wall of the second cap and the outer surface 19 of the tube side wall and the adhesive bead 24 at the second end of the tube functions to secure the second cap to the tube. The second cap forms a substantially water-tight seal about the second end of the tube, encapsulating thereby the explosive material within the tube. As a result, a substantially water-tight explosive package 17 (FIG. 4) is formed with the explosive material 65 (FIG. 1) sealed within the explosive package and protected against moisture.

An initiator 45 (FIG. 1) is inserted into the open-ended cavity 37 of the re-entrant portion 30 of the first cap. 14, engaging the side wall 34 of the re-entrant portion. Thus, the initiator is positioned in close proximity with the explosive material 65 for detonation. A wire or detonating cord 49 is extended from the detonator 47 of the initiator through one of the slots 43 or 44 (FIG. 2) formed in the side wall 34 of the first cap. The slots prevent the wire from being caught or engaged between the base of the first cap and the ridge 57 of a second cap or rocks, or the like, on which the first cap is seated, to prevent the wire from being snagged or broken as the explosive package is set.

As FIG. 4 illustrates, the explosive package 17 is lowered into a blast hole 67 formed in the ground or rock at a blast site. The wire 49 is extended out through the slot 43 and is extended out of the blast hole 67 for attachment to a detonating means such as a plunger or an electric circuit detonator. If necessary, additional explosive packages 17 can be seated or stacked on top of the preceding explosive packages, with the first caps of the upper explosive packages seated within the recesses 64 formed in the second caps of the lower explosive packages. This seating engagement between explosive packages enables specific lengths of explosive packages to be formed as needed, but still allows the explosive packages to be easily separated and removed if necessary. This seating engagement also helps guide the explosive packages down through the blast hole to prevent the explosive packages from becoming caught or twisted by roots, etc. projecting into the blast hole. The longer the explosive package, or series of packages, the easier it is for workers to load the blast hole with explosives. The greater length reduces the chances that the explosive packages can twist or become oriented sideways in the blast hole. As a result, the potential for blockages in the blast hole, as is a common problem with dynamite sticks, is avoided. In general, only one initiator 45 is required to detonate a series of stacked cartridges or canisters. However, more than one such initiator can be used if desired.

DESCRIPTION OF ADDITIONAL EMBODIMENT

Figure 5:
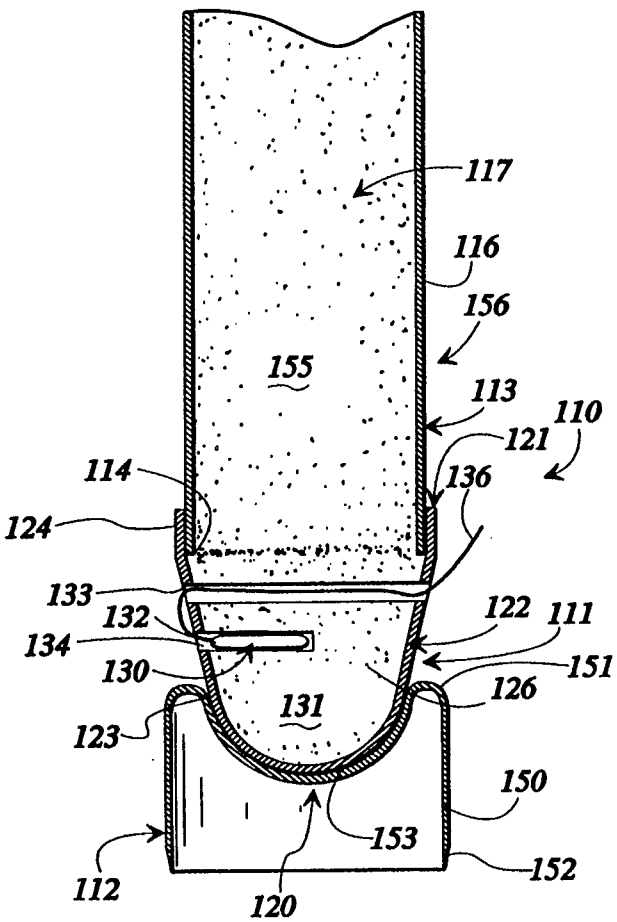
FIG. 5 is a cross-sectional view of an additional embodiment of the-explosive packaging system illustrating alternative extruded shapes for the first and second caps.

FIG. 5 illustrates an additional embodiment of the explosive packaging system 110, illustrating additional extruded shapes for the first and second cap 111 and 112 for use with larger diameter tubes 113 for blasting operations at quarries and similar blast sites. As with the previous embodiment, the tube 113 is formed from a section of PVC or similar plastic pipe cut to a desired length. The tube is typically formed from standard size PVC pipe and can be formed from different diameter pipes as required. The tube 113 includes a first open end 114, a second open end (not shown), and a substantially cylindrical side wall 116 defining an open ended holding chamber 117 therein.

The first cap 111 is adapted to fit about the first open end 114 in sealing engagement, as previously described. As shown in FIG. 5, the first cap 111 is extruded as a substantially tapered U-shaped member formed from a plastic material. The first cap includes a rounded closed end 120 and a circular open end 121 spaced therefrom. The first cap also includes a conically shaped side wall 122 having a lower portion 123 that extends longitudinally from the closed end 120, diverging outwardly toward the open end 121, and an upper portion 124 extending longitudinally, parallel to the side wall 116 of the tube 113, defining the open end 121 of the first cap. The diameter of the open end 121 of the first cap is sized in relation to the diameter of the tube being used. The open end 121 of the first cap is sized to be an approximate fit about the first open end of the tube with the upper portion 124 of the side wall 122 engaging the outer surface of the side wall 116 in tight frictional contact for sealing the first open end of the tube. An open ended chamber or recess 126 is formed within the first cap 111 by the side wall 122 and communicates with the holding chamber 117 within the tube 113.

As illustrated in FIG. 5, an initiator 130 is received and contained within the open ended chamber 126 of the first cap 111. The initiator is typically comprised of a booster 131, which is an explosive in the form of a semi-liquid slurry or paste. The booster 131 is poured or injected into the open-ended chamber of the first cap, substantially filling the chamber. The booster can be received from an explosives manufacturer in an unpackaged state and the first cap filled on site,or can be contained in a prepackaged unit that can be received within the open-ended chamber of the first cap. Additionally, the first cap itself can be extruded and filled with a booster material such as solid pentolite prior to shipment and use. The initiator further includes a blasting cap or similar detonating means 132 embedded within the booster for setting off the booster to initiate an explosion.

As illustrated in FIG. 5, channels or passages 133 and 134 are formed in the first cap, extending through the side wall 116 and booster. Passage 133 extends laterally through the first cap 111 and through the booster 131, with the booster surrounding the passage. Passage 134 extends laterally through the first cap 111 from the left side thereof partially through the first cap and booster contained therein. The blasting cap is passed through the first passage 133 from right to left, passing completely through the first cap, and is reinserted into the first cap within the second passage 134. As a result, the blast cap is firmly embedded within the booster, and its wire or detonating cord 136 is extended back through and secured with the blast cap in contact with the booster.

Figure 6:
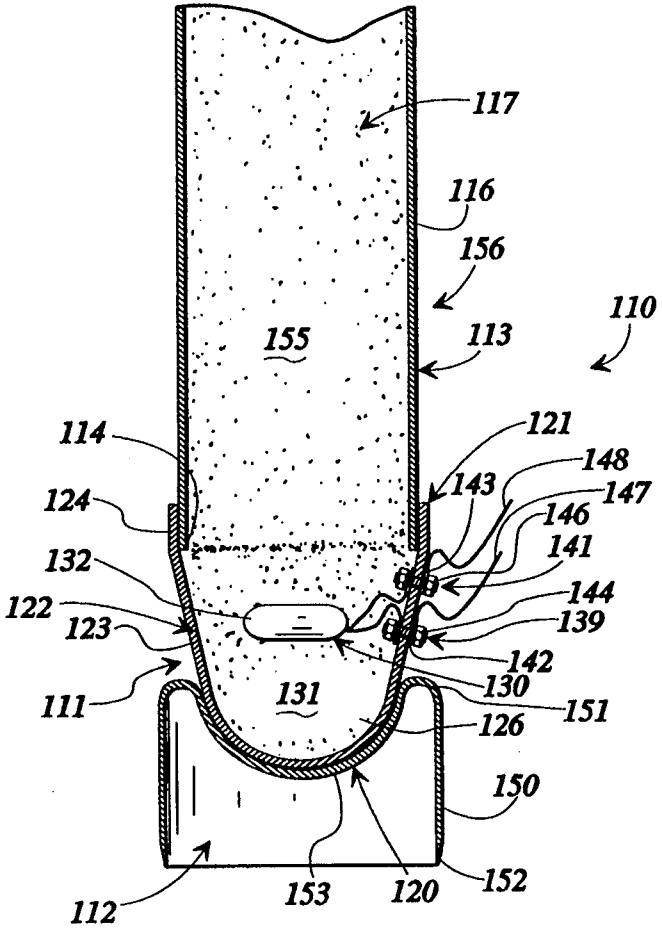
FIG. 6 is a cross-sectional view of the additional embodiment of the explosive packaging system, including terminal connectors protruding through the side wall of the first cap.

As shown in FIG. 6, instead of being placed in passages formed through the first cap, the blast cap 132 is embedded within the booster material 131. The leads of the blast cap 132 are Connected to a pair of insulated, waterproof terminals 139 and 141. The terminals comprise connector posts 142 and 143 that protrude through the side wall 116 of the first cap. A seal is provided about each connector post to protect against the passage of moisture into the first cap. Lock nuts 144 and 146 are attached to ends of the terminals. Wires 147 and 148 are connected to the terminals for attaching the blasting cap to a battery or similar detonation device for setting off the detonator.

As FIGS. 5 and 6 illustrate, the second cap 112 includes a cylindrically shaped outer wall 150 projecting downwardly. The side wall 150 includes circular upper and lower edges 151 and 152. A substantially hemispherically shaped recess 153 is formed within the upper edge 151 of the second cap. The recess is contoured so as to enable the closed end 120 of the first cap to be received and seated there. Such construction enables the stacking of successive explosive packages one on top of another as necessary for blasting a particular site.

In operation and use of the explosive packaging system 110, the first cap is filled with a booster material, and a blast cap 132 or similar detonator is embedded therein. The blasting cap is fed through the first passage 133, with its wires extending therethrough and away from the first cap, and is then reinserted into the first cap within the second passage 134 to embed the blast cap within the booster material. A tube 113 is then attached to the first cap by first coating the tube with an adhesive adjacent its first open end. The first open end 114 of the tube is urged into the first cap with the outer surface of side wall 116 of the tube engaging the upper portion 120 of the side wall 122 of the first cap in adhesive and tight frictional contact to seal the first cap about the first open end of the tube. After the first open end of the tube has been sealed thusly, the holding chamber 117 of the tube is filled with ANFO explosive 155 and the second open end of the tube is sealed with a second cap 112. As a result, an explosive package 156 of a specific size is formed, with the size of the explosive package tailored to fit the particular blasting operation for which it is designed to be used.

Where terminal connectors 139 and 141 (FIG. 6) are used in place of the passages 133 and 134, the wire leads of the blasting cap are attached to the ends of the connector posts of the terminals within the chamber of the first cap. Wires 147 and 148 are attached to the ends of the connector posts of the terminals protruding outwardly from the side wall of the first cap and are secured by locking nuts as indicated. The wires 147 and 148 connect the blasting cap to an electrical detonator for setting off the blasting cap and thus the booster to initiate an explosion. As discussed previously, the completed explosive package is loaded into a blast hole and is thereafter detonated to blast the site.

The construction of the above described packaging system for explosives enables the use of a variety of low-cost low-sensitivity explosives to be used at blast sites even where large amounts of moisture are present. Additionally, the explosive packaging system described in the foregoing can be easily and economically constructed by workers in the field using standardized inexpensive materials, and it makes feasible a wide variety of sizes of explosive packages to be constructed and utilized for blasting operations.

It will be understood by those skilled in the art that while the first cap is shown in preferred embodiments, the bottom cap can also be extruded in a variety of different shapes and sizes as necessary to incorporate different styles of initiators therein. Blasting sites have different characteristics and requirements that require different types of initiators for a larger or smaller blast. For example, some blast holes require larger, longer tubes and thus require larger initiators to initiate the explosion.

Additionally, it will be understood that the present explosive packaging system can be utilized for packaging hard powder explosives as well as ANFO. The conditions at some blast sites will necessitate at times that ANFO cannot be used and that instead a hard powder explosive must be used, but the condition of the blast hole itself is so poor such that the blast hole cannot be properly loaded with a hard powder explosive such as dynamite sticks. In such cases, the hard powder explosives can be loaded into a tube of the packaging system as done with the ANFO to form an explosive package that can be loaded into the blast hole and which will protect the hard powder explosives during loading. Thus, the present invention has application with all types of explosives, including such hard powder explosives as dynamite, as well as the cheaper, low sensitive explosives such as ANFO.

It will be obvious to those skilled in the art that many variations and modifications may be made to the above described embodiments herein chosen for the purpose of illustrating the present invention without departing from the spirit and scope of the present invention.

I claim:

1. A packaging system for explosives, comprising:

a tubular member having first and second open ends, an outer side wall, and an inner side wall defining a holding chamber for containing an explosive material therein;

a first cap having a closed end, an open end, said closed end having a smaller cross-sectional area than said open end, and a side wall extending from said closed end toward said open end and defining a chamber for receiving and containing an initiator for the explosive material contained in said tubular member in proximity thereto, with said open end of said first cap adapted to engage said outer side wall of said tubular member for attaching said first cap to said first open end of said tubular member for sealing said first open end; and a second cap adapted to be received over said second open end of said tubular member and having a side wall having an inside diameter greater than the outer side wall of said tubular member, for engaging said outer side wall for sealing said second open end of said tubular member.

2. The packaging system of claim 1 and wherein said side wall of said first cap includes a re-entrant portion having an end closure wall, an open end remote from said end closure wall, with said side wall defining an elongate cavity within said re-entrant portion.

3. The packaging system of claim 1 and wherein said second cap further comprises a recessed transverse wall and a centrally positioned cylindrical member projecting from said recessed wall and spaced from said side wall, defining a recess therebetween adapted to receive a first cap of an adjacent tubular member in a seated engagement to enable stacking of successive packaging systems in series.

4. The packaging system of claim 1 and wherein said second cap is configured to receive and hold a first cap of another packaging system.

5. The packaging system of claim 1 and wherein said tubular member is a pipe of a desired length formed from a polyvinyl chloride material.

6. The packaging system of claim 1 and further including a passage formed through said first cap adjacent its closed end adapted to receive a detonating means for said initiator therein.

7. The packaging system of claim 1 and further including terminal connectors extended through said side wall of said first cap and engaging the initiator for connecting the initiator to an electric circuit for detonating the initiator.

8. An explosive package, comprising:

an open-ended tube adapted to receive an explosive material therein;

a first cap member having an inner re-entrant portion adapted to project into said tube and the explosive material therein, and an outer sleeve spaced from said re-entrant portion for engaging a first open end of said tube for sealing said first open end;

a second cap member adapted to engage and fit about a second open end of said tube for sealing said second end of said tube; and an initiator positioned within said re-entrant portion of said first cap member for initiating detonation.

9. The explosive package of claim 8 and wherein said re-entrant portion of said first cap is a substantially cylindrical member having an end closure wall, an open end opposite said end closure wall, and a substantially cylindrical side wall defining an elongate cavity therein.

10. The explosive package of claim 8 and wherein said tubular member is a pipe of a desired length formed from a polyvinyl chloride material.

11. The explosive package of claim 9 and wherein said first cap member further includes at least one slot formed in said side wall of said re-entrant portion adjacent said open end of said re-entrant portion.

* * * * *